US008027493B2

(12) United States Patent
Levitsky

(10) Patent No.: US 8,027,493 B2
(45) Date of Patent: Sep. 27, 2011

(54) BIPLANE LINE ARRAY SPEAKER WITH ARCUATE TWEETER ARRAY PROVIDING CONTROLLED DIRECTIVITY

(75) Inventor: Igor Levitsky, Richmond Hill (CA)

(73) Assignee: Bohlender Graebener Corporation, Carson City, NV (US)

( * ) Notice: Subject to any disclaimer, the term of this patent is extended or adjusted under 35 U.S.C. 154(b) by 1391 days.

(21) Appl. No.: 11/539,600

(22) Filed: Oct. 6, 2006

(65) Prior Publication Data

US 2007/0110269 A1 May 17, 2007

Related U.S. Application Data

(60) Provisional application No. 60/724,598, filed on Oct. 7, 2005.

(51) Int. Cl.
*H04R 25/00* (2006.01)
*H04R 1/02* (2006.01)

(52) U.S. Cl. ..... 381/184; 381/186; 381/386

(58) Field of Classification Search ..... 381/182, 381/184, 186, 386, 387, 87, 332, 335, 336, 381/345, 351, 300, 304, 305, 307; 181/198, 181/199, 148, 144, 145
See application file for complete search history.

(56) References Cited

U.S. PATENT DOCUMENTS

2006/0153407 A1* 7/2006 Keele et al. ..... 381/182

FOREIGN PATENT DOCUMENTS

WO WO 98/07297 * 2/1998

* cited by examiner

*Primary Examiner* — Tuan Nguyen
(74) *Attorney, Agent, or Firm* — Fenwick & West LLP

(57) ABSTRACT

A biplane line array speaker includes a line array of tweeters mounted substantially directly in front of a line array of woofers. The tweeter line array is arcuately shaped to provide controlled vertical dispersion above and below the boundaries of the speaker cabinet. The woofers are displaced from the tweeters in stepped manner. The speaker cabinet is a rectangular box, allowing efficient wall mounting in single or multiple unit columns. In multiple unit columns, the individual units acoustically couple to each other.

16 Claims, 6 Drawing Sheets

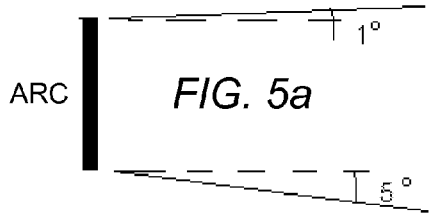
FIG. 5a
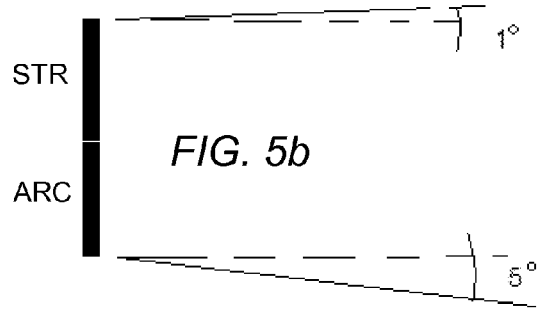
FIG. 5b
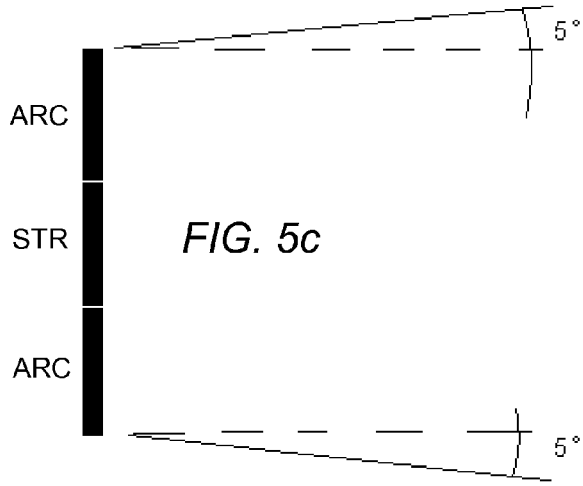
FIG. 5c
FIG. 5d
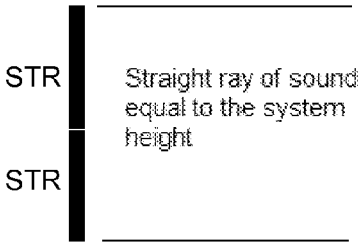
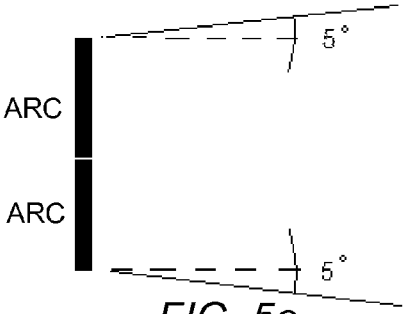
FIG. 5e

BIPLANE LINE ARRAY SPEAKER WITH ARCUATE TWEETER ARRAY PROVIDING CONTROLLED DIRECTIVITY

CROSS-REFERENCE TO RELATED APPLICATION

This application claims the benefit under 35 U.S.C. §119 (e) of U.S. Provisional Application Ser. No. 60/724,598 filed on Oct. 7, 2005, which is incorporated by reference herein.

BACKGROUND

Controlling directivity of loudspeakers has always been one of the most important problems in commercial sound reproduction. Being able to aim and deliver sound energy precisely to one area and prevent the sound energy from falling onto another is one of the challenges of sound system designers. A speaker system with well controlled directivity will have precise and even SPL (sound pressure level) coverage of the audience area, providing desired speech intelligibility and balanced reproduction. In addition, controlled directivity helps avoid reflective surfaces, insuring controlled reverberation and minimum interference with direct sound.

Various devices have been used to control sound dispersion. The horn is one of the methods that is quite effective for mid and high frequency transducers. Another effective method that is known from antenna theory is using multiple drivers arranged in a line source or array.

The directive properties of such line sources or arrays are known. If transducers are spaced very close to each other in long line with a length that is comparable to or larger than a wavelength of radiated sound, then such a system generally exhibits rather directive properties on its axis and would project sound without wasting too much energy on off-axis radiation.

A line array system concept is derived from line source theory. An ideal line source is an infinite, thin (narrow) and continuous vibrating element, which radiates cylindrical waves. Such a line source has an important radiation property, which is that its SPL level decreases inversely proportionately to the distance from the source, losing only 3 dB with each doubling of the distance. A point source radiator (common loudspeakers are considered to be point source radiators) generates a spherical wave. Its SPL decreases inversely proportionately to the square of the distance from the source, losing 6 dB with each doubling of the distance.

This phenomenon can be understood, considering that expansion of a cylindrical wavefront results in a surface area gain being proportionate to increasing distance, while expansion of a spherical wavefront produces an area gain, which is proportionate to the square of the distance.

Unlike the infinite ideal line radiator, a line source with limited length has limited extension of its cylindrical wavefront zone (near field). Beyond a certain distance, the cylindrical wavefront gradually transforms into the spherical wavefront (far field) and the system becomes a point source device. The distance, defining a border between the near and far field zones, depends on the line source length and frequency. Generally, the near field extends from the line source to a distance $D=L^2f/636$, where L is the length of the line array, and f is the relevant frequency. Within the near field the SPL loss is about 3 dB and the intensity is proportional to about l/r, where is the listener's distance from the line source. In the far field, the SPL loss is about 6 dB, and the intensity is proportional to $1/r^2$.

The benefits of a line source in comparison to a point source system can be stated as follows. First, a significantly smaller SPL reduction with distance allows for delivering higher sound volume levels further to the audience. Second, at a given sound level at the back of a venue a line source would produce much smaller difference in SPL levels throughout the venue, with SPL being significantly lower in close proximity to the source. This provides very comfortable listening conditions without the danger of overpowering the audience in the front rows. Third, the cylindrical wavefront provides very controlled energy dispersion in the plane, which coincides with the line source (in most applications this would be the vertical plane), resulting in excellent intelligibility even in a very reverberant environment.

Multiple transducers have been used to build column speakers to deliver direct sound further to the audience. However the problem is that conventional transducers or compression drivers do not work well in such applications at high frequencies. A true line array system is different from a line source in that it consists of a discrete array of transducers and has limited length. In this case, the notion of a continuous line source should be considered in the relationship between line array geometry and the wavelength of reproduced sound. The primary question defining the proper operation of a line array is whether the array can be considered as a continuous line source over the reproduced frequency range.

Consider a line array system comprising a number of linearly placed, spaced apart drivers on a length L, where P is an equivalent radiating piston height (diameter for a circular piston) of a driver, and H is a space taken by each driver or distance between driver centers. The condition that defines a discrete line array as a line source can be related to two different shapes of the radiating element. For circular drivers, proper line source behavior, or "coupling", can be achieved in a frequency range where:

$$H<\lambda,$$

where $\lambda$ is a wavelength at a given frequency.

For example, to fulfill this condition at 10 kHz and above, drivers must be spaced with less than 1.33" (3.4 cm) between driver centers.

This spacing requirement is a completely unrealistic condition for a practical design using 1" or even 0.75" dome tweeters, which would obviously require a greater spacing. This means that conventional line arrays using conventional cone drivers cannot properly perform as a line source at high frequencies. If a line array is not properly coupled, the resulting dispersion is far from consistent and exhibits severe lobing along with significant SPL irregularities within the coverage area.

As noted above, a line source system where drivers are positioned in a line and are driven with the same signal possesses very narrow vertical dispersion. Depending on the system's length and frequency, the vertical dispersion beyond the array's upper and lower limits approaches zero degrees. This means that a straight array radiates sound strictly between upper and lower planes limited with its physical dimensions. In applications where the audience is located on a flat floor such configuration is acceptable.

However, for many environments (e.g., large halls, venues, etc.) such controlled dispersion is a disadvantage since the audience may be located on elevated/tiered floor with height gradient M at the back. Some conventional solutions simply try to use more straight columns. In order for a system of straight columns to cover the audience in such venue it would be necessary to install a straight system of the exact height M. This increases the cost and complexity of such an installation.

Another existing option is to use discrete arrays where each driver set is installed in a physically separate box and all the boxes are connected through elaborate system of hinges and pins; the boxes are then usually mounted on a special bumper bar, and metal chains and motors are used to attach the speaker array to the ceiling. Such installations tend to be prohibitively expensive for many applications, and certainly is not capable of being wall mounted in most medium size venues.

SUMMARY

The present invention is a commercial music/public address speaker, incorporating a dual line arrays of tweeters and woofers in a biplane arrangement in a single speaker cabinet. In the biplane configuration, a line array of tweeters is mounted substantially directly in front of a line array of woofers; that is the respective vertical axes of the arrays are aligned along the primary listening axis (the axis directly outwardly toward the audience). The coaxial relationship of the two line arrays ensures that system directivity is symmetrical.

In one embodiment, the tweeters are mounted in a line array on a sheet metal panel which is bent in total arc angle of approximately 3 degrees to 10 degrees. This enables the speaker unit to provide about 1 degree vertical dispersion over the top end of the cabinet, and approximately 5 degree vertical dispersion below the bottom end of the cabinet. The woofers are mounted in a line array behind the tweeter array, but in a staggered or stepped back manner so as to maintain an approximately constant distance between the woofer centers and the tweeters in front of them.

In one embodiment, the tweeter array is mounted in front of the woofer array using various height standoffs that allow the arc of the tweeter array to be varied from 0 degrees to approximately 10 degrees, and yet maintained with the confines of the speaker cabinet. This allows for a single manufactured speaker box to be variably configured for different applications, thereby reducing manufacturing costs and providing more flexible application options. Thus, both a straight dispersion speaker (i.e., one with 0 degrees vertical dispersion beyond the cabinet limits) and a controlled vertical dispersion speaker (about 1 to 5 degrees beyond cabinet limits) can be built, using substantially the same parts.

The combination of the tweeter array and woofer array in a single, box speaker cabinet enables the speaker to be easily mounted on a wall, without requiring complex mounting hardware, and yet providing the desired performance of controlled vertical dispersion.

The present invention also includes various configurations using a plurality of the speaker cabinets. Combinations include vertical arrangements or one, two, or more of the cabinets, in which the top and bottom limits of vertical dispersion can be controlled by selective use of both controlled vertical dispersion and straight dispersion speakers. The vertical arrangements provide for increased output and coverage, and yet can all be easily wall mounted without requiring complex mounting hardware.

The features and advantages described in this summary and the following detailed description are not all-inclusive. Many additional features and advantages will be apparent to one of ordinary skill in the art in view of the drawings, specification, and claims hereof.

BRIEF DESCRIPTION OF THE DRAWINGS

FIGS. 5*a*-5*e* illustrate the vertical dispersion patterns of various combinations of speakers.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 1:
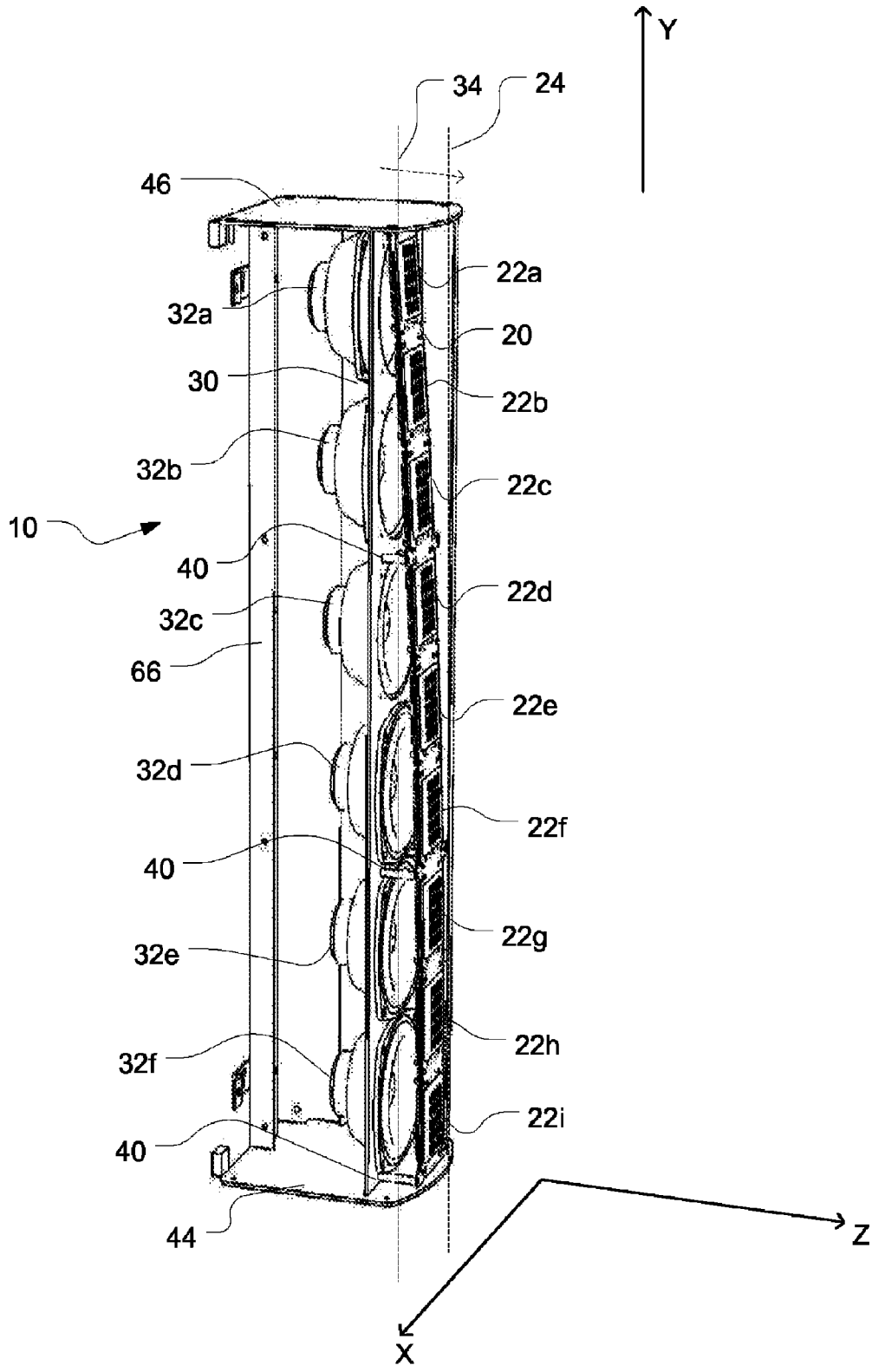
FIG. 1 illustrates a cross-sectional, perspective view of a speaker in one embodiment of the invention.
Figure 2:
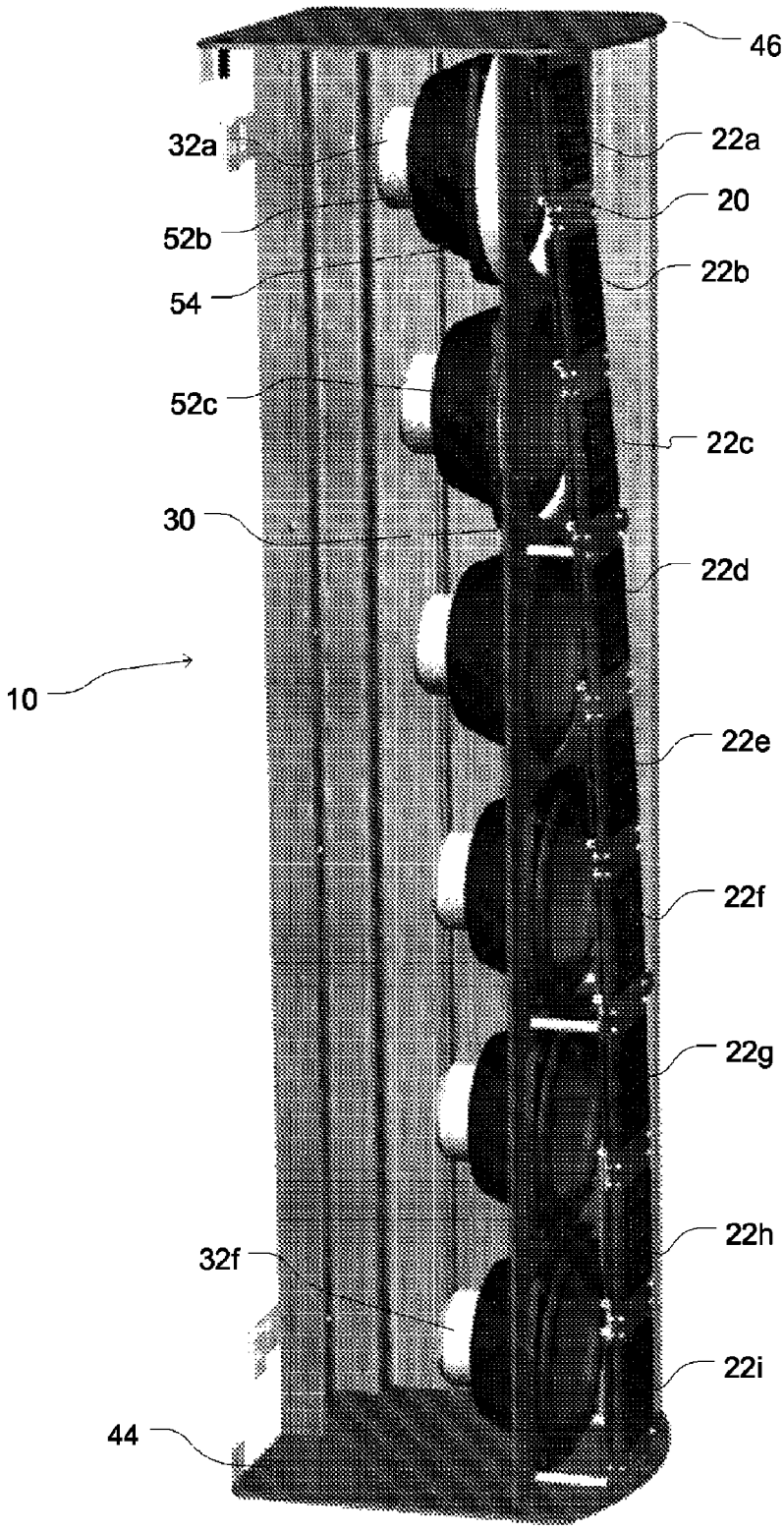
FIG. 2 illustrates another cross-sectional, perspective view of the speaker.

Referring now to the figures, there is shown one embodiment of the present invention. FIGS. 1 and 2 show cross sectioned views of a speaker cabinet 10. In one embodiment, each speaker cabinet 10 is about 32" long, 7.5" wide, and 8.3" deep, though larger or smaller dimensions can be used as desired to obtain different size configurations and acoustic performance. Installed in the cabinet 10 is a woofer panel 30 comprising a plurality of woofers 32 in a line array, and a tweeter panel 20 comprising a plurality of tweeters 22 in a line array. The tweeters are preferably 3" planar ribbon drivers, while the woofers are preferably 5.25" woofers (of any type); a passive crossover at about 2 kHz is preferred. The two line arrays are configured in a biplane arrangement in which the tweeter line array on the tweeter panel 20 is mounted substantially directly in front of the line array of woofers 32 on the woofer panel 30. In one embodiment of the biplane arrangement, the vertical axis 24 of the tweeter array is horizontally (left to right) aligned with the vertical axis 34 of the woofer array with respect to the aiming axis 50 (the axis normal to the front face of the cabinet). In other words, the tweeter axis 24 and the woofer axis 34 are aligned in the X-Y plane, where the Z axis is the aiming axis 50, the X axis is the horizontal axis, and the Y axis is the vertical axis, as illustrated in FIG. 1. The term 'biplane' does not here require that the tweeter panel 20 and woofer panel 30 be individually in perfect planes, or that the relationship between them is that of perfectly flat, parallel planes.

In this embodiment, the tweeter panel 20 has an arcuate front surface, in which the arc is preferably 5 degrees. The tweeter panel 20 preferably is a continuous curved surface. In one embodiment, the tweeter panel 20 is a 2 mm steel panel, though other materials may be used as well. The surface curvature of the tweeter panel 20 is achieved in one embodiment using progressively shorter standoffs 40 between the tweeter panel 20 and the woofer panel 30. Alternatively, the panel 20 can be fashioned with integral extending legs which are bent perpendicular to the panel, cut to the appropriate height, and then fastened to the panel 30. The arc of the tweeter panel can be set to be from 0 degrees to approximately 10 degrees depending on the height and placement of the standoffs (or the length of the legs), and yet maintained with the confines of the speaker cabinet 10. The degree of arc of the tweeter panel 20 and its relative top to bottom positioning determines the vertical dispersion of the speaker.

In one embodiment, the tweeter panel 20 is configured to provide controlled vertical dispersion. In this embodiment the vertical dispersion relative to the top of the speaker cabinet 10 is approximately 1 degree, and the vertical dispersion relative to the bottom of the speaker cabinet 10 is approximately 5 degrees. This configuration is illustrated in FIG. 5*a*. This configuration has been found to be beneficial for some installations in which the speaker cabinet 10 is mounted on a wall or stand at some distance (e.g., 3 to 10 feet) from the ground; the controlled top dispersion reduces the loss of speaker energy over the heads of the audience and further reduces unwanted reflections from the ceiling, which would otherwise impair the intelligibility of the audio source. The greater vertical dispersion from the bottom end of the speaker cabinet 10 provides for ample coverage of the audience. In alternative embodiment of the invention, a deeper cabinet 10 is used in conjunction with a more arcuately curved tweeter panel, thereby increasing the coverage angle to approximately 10 degrees. Of course, depending on the installation requirements, the speaker cabinet 10 can be mounted "upside down" so as to provide the greater vertical dispersion at the top of speaker 10 (e.g., for an audience that is on a significantly upwardly sloped surface).

Figure 3:
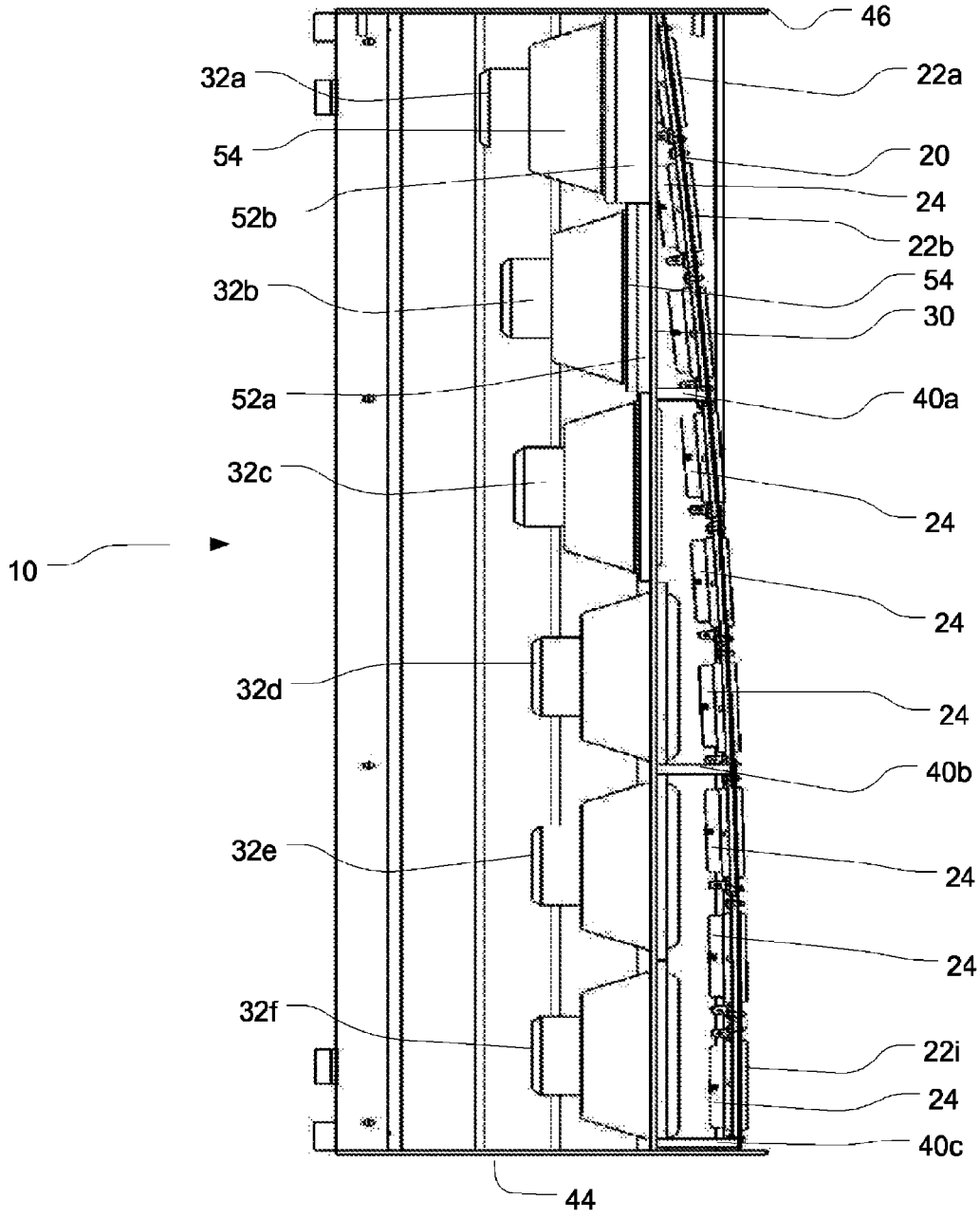
FIG. 3 illustrates a cross-sectional, plan view of the speaker.

The woofers 32 are mounted in a line array behind the tweeter panel 20, in preferably a staggered or stepped back manner as illustrated in FIGS. 1-3. FIG. 3 shows a side view of the tweeter panel 20 in relationship to the woofer panel 30. The bottom three woofers 32*d-f* are mounted from the front of woofer panel 30, thereby having their acoustic centers in a same plane. The fourth woofer 32*c* is mounted from behind of the woofer panel 30, thereby stepping its acoustic center back a distance equal to the thickness of the woofer panel 30 and the mounting flange of the woofer. For the fifth woofer 32*b*, a spacer 52*a* (preferably 6 mm, but variable) is placed between the woofer mounting flange 54 and the back of the woofer panel 30, so that this woofer is mounted even further back. The sixth woofer 32*a* is stepped further back from the woofer panel using a thicker spacer 52*b* (e.g. 15 mm). This stepped mounting has two benefits. First, the stepped mounting allows tweeter back cups 24 to clear the woofer faces, and second, it maintains at least consistency in delay (distance) between tweeter and woofer which is important for wavefront integrity and phase coherence. The woofer panel 30 is preferably a straight panel with the appropriately dimensioned apertures cut out for the woofers. Alternatively, the stepped back configuration may be achieved by forming the woofer panel directly with stepped front and rear surfaces. For example, the woofer panel can be milled (or machined) solid panel of MDF or similar dense, rigid material, or constructed from several layers of different lengths bonded together, so that the respective mounting surfaces for the woofers are appropriately staggered to provide the stepped back profile.

As shown in the figures, the tweeter panel 20 has an arcuate shape, with approximately 5 degrees of arc between the top end (towards tweeter 22*a*) and the bottom end (towards tweeter 22*i*). The degree of arc can be adjusted using various heights of standoffs 40, or by similar mechanical means, such as risers, screw mounts, or the like. FIG. 3 illustrates an embodiment using standoffs 40 with three different heights; a tallest standoff 40*c* between the tweeter panel 20 and the woofer panel 30 near the end cap 44; a second, shorter standoff 40*b* where the tweeter panel 20 couples to the woofer panel 30 between woofers 32*d* and 32*e*, and a shortest standoff 40*a* where the tweeter panel 20 couples to the woofer panel 30 between woofers 32*b* and 32*c*. Again, instead of standoffs 40, legs integral to the panel 20 may be extended, bent, and cut to length to achieve the desired height at each mounting location. The tweeter panel 20 is then coupled substantially directly to the woofer panel 30 near the opposite end cap 46. The bottom portion of the tweeter panel 20, from about the location of tweeter 22*i* to where the tweeter panel 20 meets end cap 44 is parallel to the woofer panel 30. The tweeter panel 20 is also perpendicular to the end cap 44 where they meet. The radiating area of tweeter 22*i* extends to preferably about 0.125" from end cap 44. The advantage of this geometry is that two of the speaker units can be placed with end caps 44 together, with the result that the ends of the tweeter panels 20 align along a common plane with only about 0.25" gap therebetween. This further ensures a smooth acoustic coupling between the two speaker units 10.

Figure 4:
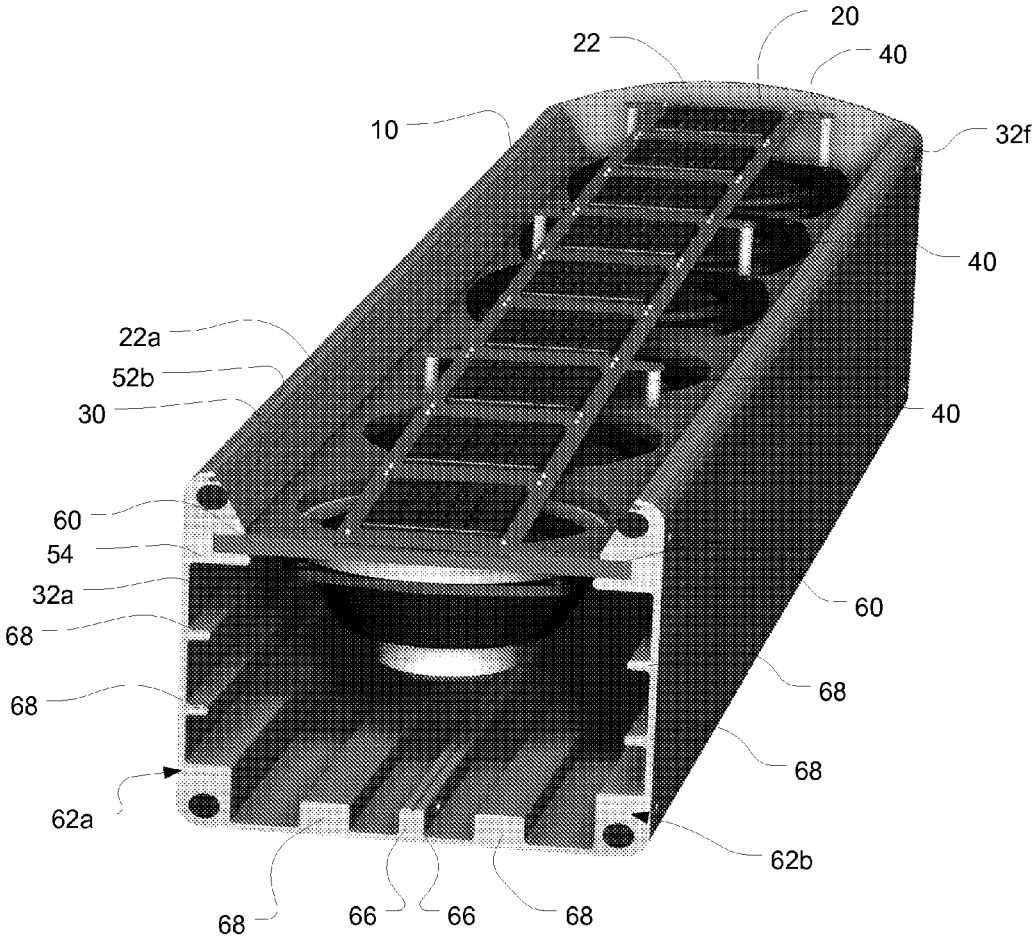
FIG. 4 illustrates a further cross-sectional view of the speaker cabinet.
Figure 6A:
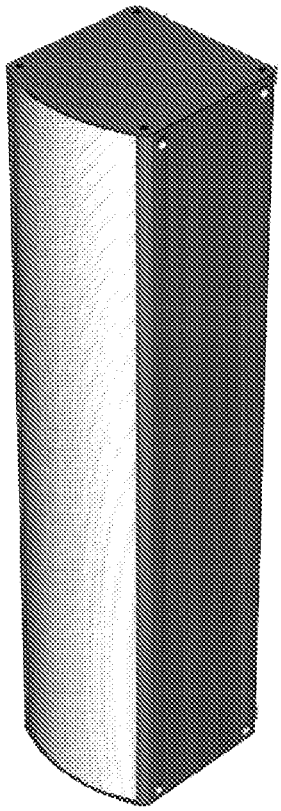
FIGS. 6*a* and 6*b* illustrate external views of the speaker.
Figure 6B:
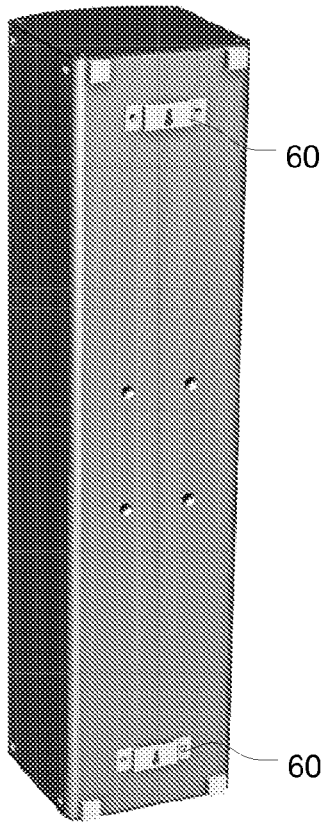

As illustrated in FIG. 4, the speaker cabinet 10 is preferably extruded aluminum, formed into two panels 62*a* and 62*b* and securely coupled together, for example along facing vertical flanges 66 down the back side of the cabinet 10. The woofer panel 30 is slotted into vertically running slots 60 in the panels 62. The vertically running ribs 68 provide increased rigidity and reduce cabinet resonances. The cabinet can alternatively be made of wood, MDF, a composite material, or the like, and can be milled, cast, formed, or otherwise manufactured. FIGS. 6*a* and 6*b* illustrate in perspective the outer structure of the speaker 10 from front right (FIG. 6*a*) and the rear left (FIG. 6*b*). In FIG. 6*b* there is shown the keyhole wall mounting brackets 60 which enable easy wall mounting without complex hardware.

The straight cabinet 10 enables easy stacking, placement, and mounting on walls and other surfaces, while the bent tweeter array can provide about 5 degree of vertical dispersion coverage. By contrast, a conventional line array column has 0 degree coverage when tweeters are located in a line; in order to obtain a greater vertical dispersion, a column of conventional speaker boxes have to be angled relative to one another, making it extremely difficult to mount directly on a wall or other flat surface.

The various embodiments are constructed using very shallow/flat planar ribbon tweeters. Planar ribbon tweeters are preferred, though very small dome tweeters that are as shallow as ribbons may be used. In either implementation, the tweeters need to be placed sufficiently close to each other so that their active transducer surfaces acoustically couple together at relatively high frequencies, creating continuous arced acoustic source.

The other aspect of the invention is that multiple ones of the speaker units 10 can be stacked together in various configurations to make an array as long as needed. This is done by forming a column including at least speaker 10 (which has a controlled vertical dispersion) with at least one speaker unit having straight (i.e., approximately 0 degrees) vertical dispersion. This latter speaker unit is manufactured using substantially the same parts as the speaker 10, but having a flat tweeter panel set a fixed distance from the woofer panel (e.g., using standoffs or legs of a single height), and mounting all of the woofers 32 on the front (or back) of the woofer panel 30 (eliminating the spacers 52). Thus, a single manufacturing line may be used for both types of speakers. For the straight dispersion speaker, the distance between the tweeter panel and the woofer panel matches the distance between the tweeter panel 20 and the woofer panel 30 at end cap 44, thereby again ensuring proper acoustic coupling between the straight dispersion speaker and the controlled dispersion speaker 10.

FIG. 5 illustrates various ones of the configurations that can be achieved. In this figure, the label "ARC" designates a speaker unit 10 using the arcuate tweeter array, and the label "STR" designates a speaker unit with straight vertical dispersion. FIG. 5*a* illustrates the controlled vertical dispersion of a speaker 10 oriented so that the top vertical dispersion is 1 degree, and the bottom vertical dispersion is 5 degrees. Here, the bottom end of the arcuate speaker is substantially adjacent to the top end of the straight speaker so that their respective acoustic outputs couple together. FIG. 5*b* illustrates a two unit column in which the top unit has a straight vertical dispersion and the bottom unit 10 has the controlled bottom vertical dispersion of 5 degrees. FIG. 5*e* illustrates that two speaker units 10 can be placed in a column with one inverted with respect to the other (i.e., coupled together at end caps 44) so that the controlled vertical dispersion on both ends (top and bottom) is 5 degrees. This configuration uses simple rectangular brackets and screws to secure the units together and effective doubles the coverage angle. The benefit of such configuration is that it provides 10 degrees of well-controlled coverage and still has the whole system being a straight column that could be easily mounted on a wall. Conventional approaches in which the speaker cabinets themselves are angled with respect to each other are very difficult to properly install against a wall, and have an awkward appearance since the fronts of the cabinets form a somewhat pointed, broken façade.

Another configuration is shown in FIG. 5*c*, in which two speaker units 10 are placed in a column with at least one straight dispersion speaker in between them, with both the upper and lower units 10 arranged to have their greater vertical dispersion ends oriented towards the column ends. In the various configurations of FIGS. 5*a*-5*d* the ends of the various speakers are substantially adjacent so as to acoustically couple their respective acoustic outputs. The ends can be directly placed together, or slightly separated (e.g. by a space or by a protective material).

The present invention has been described in particular detail with respect to various embodiments, and those of skill in the art will appreciate that the invention may be practiced in other embodiments. The language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims.

I claim:

1. A loudspeaker having a biplane arrangement of line arrays, comprising:

a housing;

a woofer panel disposed in the housing and comprising a first line array of low frequency transducers, each transducer having an acoustic center, the first line array having a first axis through the acoustic centers of the low frequency transducers, wherein the first line array has a staggered configuration such that the low frequency transducers are staggered with respect to the woofer panel; and a tweeter panel disposed in the housing and in front of the woofer panel, and comprising a second line array of high frequency transducers, each transducer having an acoustic center, the second line array having a second axis that is substantially aligned in front of the first axis, and passes through the acoustic centers of the high frequency transducers, and wherein there is a substantially uniform distance between the first and second axes.

2. The loudspeaker of claim 1, wherein the second line array has a substantially arcuate configuration.

3. The loudspeaker of claim 1, wherein each low frequency transducer has a mounting flange, and wherein for a plurality of the low frequency transducers there are spacers of varying thickness disposed between the mounting flanges and the woofer panel, so as to stagger the low frequency transducers.

4. The loudspeaker of claim 1, further comprising a plurality of standoffs disposed between the tweeter panel and the woofer panel, at least some of the standoffs having varying heights.

5. The loudspeaker of claim 4, wherein the tweeter panel comprises a thin, flexible metal panel.

6. The loudspeaker of claim 1, wherein the first line array has a staggered configuration, and wherein the woofer panel comprises a plurality of stepped surfaces, and the low frequency transducers are mounted to stepped surfaces, so as to provide the substantially uniform distance between the first and second axes.

7. The loudspeaker of claim 1, wherein:

the first line array has a first primary listening axis substantially perpendicular to a plane of the woofer panel; and the line array of high frequency transducers has a second primary listening axis positioned substantially coincident with the first primary listening axis of the first line array.

8. The loudspeaker of claim 1, wherein the housing comprises a back side that is straight.

9. The loudspeaker of claim 1, wherein the tweeter panel comprises a thin, flexible metal panel.

10. The loudspeaker of claim 1, wherein the housing comprises a back side that is straight.

11. A loudspeaker having a biplane arrangement of line arrays, comprising:

a housing;

a woofer panel disposed in the housing and comprising a first line array of low frequency transducers, each transducer having an acoustic center, the first line array having a first axis through the acoustic centers of the low frequency transducers; and a tweeter panel disposed in the housing and in front of the woofer panel, and comprising a second line array of high frequency transducers, each transducer having an acoustic center, the second line array having a second axis through the acoustic centers of the high frequency transducers, and wherein there is a substantially uniform distance between the first and second axes, and wherein the second line array has a substantially arcuate configuration.

12. The loudspeaker of claim 11, wherein the first line array has a staggered configuration such that the low frequency transducers are staggered with respect to the woofer panel.

13. The loudspeaker of claim 12, wherein each low frequency transducer has a mounting flange, and wherein for a plurality of the low frequency transducers there are spacers of varying thickness disposed between the mounting flanges and the woofer panel, so as to stagger the low frequency transducers.

14. The loudspeaker of claim 12, comprising a plurality of standoffs disposed between the tweeter panel and the woofer panel, at least some of the standoffs having varying heights.

15. The loudspeaker of claim 11, wherein the first line array has a staggered configuration, and wherein the woofer panel comprises a plurality of stepped surfaces, and the low frequency transducers are mounted to stepped surfaces, so as to provide the substantially uniform distance between the first and second lines.

16. The loudspeaker of claim 11, wherein:

the first line array has a first primary listening axis substantially perpendicular to a plane of the woofer panel; and the line array of high frequency transducers has a second primary listening axis positioned substantially coincident with the first primary listening axis of the first line array.

* * * * *